US008337227B2

(12) United States Patent
Arai et al.

(10) Patent No.: US 8,337,227 B2
(45) Date of Patent: Dec. 25, 2012

(54) WATER STOP STRUCTURE FOR WIRE HARNESS

(75) Inventors: Masaru Arai, Yokkaichi (JP); Naohito Sawamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 130 days.

(21) Appl. No.: 12/990,290

(22) PCT Filed: Mar. 11, 2009

(86) PCT No.: PCT/JP2009/054644

§ 371 (c)(1),
(2), (4) Date: Oct. 29, 2010

(87) PCT Pub. No.: WO2009/139220

PCT Pub. Date: Nov. 19, 2009

(65) Prior Publication Data

US 2011/0053398 A1 Mar. 3, 2011

(30) Foreign Application Priority Data

May 15, 2008 (JP) ..... 2008-128924
May 15, 2008 (JP) ..... 2008-128934

(51) Int. Cl.
*H01R 13/52* (2006.01)

(52) U.S. Cl. ..... 439/271

(58) Field of Classification Search ..... 439/271, 439/275, 589, 278, 285, 277; 174/152
See application file for complete search history.

(56) References Cited

U.S. PATENT DOCUMENTS 3,840,841 A * 10/1974 Clark ..... 439/589
4,062,612 A * 12/1977 Evans ..... 439/589
4,705,339 A * 11/1987 Hayes et al. ..... 439/277
4,795,360 A * 1/1989 Newman et al. ..... 439/278
4,841,101 A * 6/1989 Pollock ..... 174/152 GM
4,921,437 A * 5/1990 Cooper et al. ..... 439/275
6,254,428 B1 * 7/2001 Murakami et al. ..... 439/556
6,527,574 B1 * 3/2003 Murakami et al. ..... 439/275
6,632,104 B2 * 10/2003 Quadir ..... 439/587
6,716,063 B1 * 4/2004 Bryant et al. ..... 439/589
6,903,268 B2 * 6/2005 Marshall et al. ..... 174/50.59
6,953,365 B2 * 10/2005 Tabata et al. ..... 439/587
7,226,312 B2 * 6/2007 Shah ..... 439/589
7,341,484 B2 * 3/2008 Yamamoto ..... 439/587
7,618,287 B2 * 11/2009 Hass ..... 439/589
7,637,764 B2 * 12/2009 Yoneda et al. ..... 439/275
7,837,490 B2 * 11/2010 Sakamoto et al. ..... 439/278

FOREIGN PATENT DOCUMENTS

JP 11-111382 4/1999
JP 2000-40551 2/2000
JP 2004-146181 5/2004
JP 2005-166293 6/2005
JP 2006-31961 2/2006

* cited by examiner

*Primary Examiner* — Alexander Gilman
(74) *Attorney, Agent, or Firm* — Gerald E. Hespos; Michael J. Porco

(57) ABSTRACT

A wire harness is divided in an arrangement direction, and terminals are connected to ends of wires of the divided wire harnesses and respectively mounted into first and second connectors. An intermediate connector is provided which includes a first connector fitting portion and a second connector fitting portion, into which the first and second connectors respectively are fit, and a partition wall is disposed between the first and second connector fitting portions. Intermediate terminals are inserted through the partition wall of the intermediate connector and electrical contact portions at both ends of the respective intermediate terminals project into the first and second connector fitting portions. A waterproofing agent is filled in a part of one or both of the first and second connector fitting portions in contact with the partition wall to embed parts of the intermediate terminals except the electrical contact portions therein.

10 Claims, 13 Drawing Sheets

WATER STOP STRUCTURE FOR WIRE HARNESS

BACKGROUND OF THE INVENTION

1. Field of the Invention

The present invention relates to a water stop structure and is particularly designed to prevent water penetration into an electronic control unit through clearances between strands of wires constituting a wire harness when the electronic control unit and devices are connected via the wire harness.

2. Description of the Related Art

With increasing technical advantages, various electronic control units are installed in automotive vehicles and motorcycles. The electronic control unit controls various devices such as an injector and an ignition coil device based on detection signals from various sensors such as an $O_2$ sensor, a speed sensor and a knock sensor, and is connected to respective devices such as the above sensors, controllable devices and electrical components by a wire harness.

Depending on the length, arrangement path and the like of a wire harness, a wire harness W/H is divided into a unit-side wire harness W/H-1 to be connected to an electronic control unit 3 and a device-side wire harness W/H-2 to be connected to devices 4, and the electronic control unit 3 and the devices 4 are electrically connected in many cases by connecting a connector 1 mounted on an end of the unit-side wire harness W/H-1 and a connector 2 mounted on an end of the device-side wire harness W/H-2 as shown in FIG. 14.

Since the wire harness W/H provided between the electronic control unit 3 and the devices 4 is arranged through a water susceptible area subject to water such as rainwater in many cases, it is important to prevent water penetration into the interior of the electronic control unit 3.

On the other hand, the present applicant proposed a waterproof connector 5 as disclosed, for example, in Japanese Unexamined Patent Publication No. 2004-146181 as a connector to be mounted on an end of a wire harness. In the waterproof connector 5, a waterproof rubber plug 6 is closely mounted in a rear part of a housing as shown in FIG. 15. Water penetration into the interiors of the connectors 1, 2 from the outside can be prevented, for example, by using such a waterproof connector 5 as the connectors 1, 2 at the ends of the divided wire harnesses W/H-1, W/H-2.

However, also in the case of the wire harness connected to the electronic control unit and the wire harness W/H divided as shown in FIG. 14, if an insulation coating portion of the wire of the device-side wire harness W/H-2 is damaged, a part of the coating portion is peeled off or a crack reaches up to strands of the wire, water such as rainwater might penetrate to strands of the wire from the damaged part. In such a case, the water having penetrated to the strands might infiltrate through clearances between the strands by a capillary phenomenon and penetrate into the electronic control unit via a connection terminal portion.

SUMMARY OF THE INVENTION

The present invention was developed in view of the above problems and an object thereof is to, in the case of dividing a wire harness connected to an electronic control unit and devices or dividing a wire harness connected to the electronic control unit in an arrangement direction and connecting ends of the divided wire harnesses, prevent water having penetrated to a wire strand portion of one divided wire harness and infiltrated through clearances between strands from penetrating into clearances between strands of wires of the other divided wire harness and finally prevent the water from penetrating into the electronic control unit.

In order to solve the above problem, the invention is directed to a water stop structure for a wire harness for connecting an electronic control unit installed in an automotive vehicle or a motorcycle and devices. The wire harness is divided in an arrangement direction. Terminals are respectively connected to both ends of wires of the divided wire harnesses and respectively mounted into a first connector and a second connector An intermediate connector is provided and includes a first connector fitting portion and a second connector fitting portion, into which the first and second connectors are respectively to be fitted. A partition wall portion is disposed between the first and second connector fitting portions. Intermediate terminals are inserted through the partition wall portion of the intermediate connector and electrical contact portions at both ends of the respective intermediate terminals project into the first and second connector fitting portions. A waterproofing agent is filled in a part of either one or both of the first and second connector fitting portions in contact with the partition wall portion or a clearance formed in the partition wall portion to embed parts of the intermediate terminals except the electrical contact portions therein.

The invention also is directed to a water stop structure for a wire harness for connecting an electronic control unit installed in an automotive vehicle or a motorcycle and devices. The wire harness is divided in an arrangement direction. Terminals are respectively connected to both ends of wires of the divided wire harnesses and mounted into a first connector and a second connector. An intermediate connector is provided and includes a first connector fitting portion and a second connector fitting portion, into which the first and second connectors are respectively to be fitted. A partition wall portion is disposed between the first and second connector fitting portions. Intermediate terminals are inserted through the partition wall portion of the intermediate connector and electrical contact portions at both ends of the respective intermediate terminals project into the first and second connector fitting portions. A waterproofing agent is applied to parts of the intermediate terminals to be located in the partition wall beforehand and embedded in the partition wall.

As described above, in the first and second embodiments, the wire harness connecting the electronic control unit and the devices is divided, and the first and second connectors mounted on the ends of the divided wire harnesses are connected via the intermediate connector.

Further, the intermediate connector includes the partition wall portion that partitions the first and second connector fitting portions, into which the first and second connectors are to be fitted, and has the intermediate terminals inserted therethrough.

In the first embodiment, the waterproofing agent is filled in the part of either one or both of the first and second connector fitting portions in contact with the partition wall portion or in the clearance formed in the partition wall portion to embed the parts of the intermediate terminals except the electrical contact portions therein.

In the second embodiment, the waterproofing agent is applied to the parts of the intermediate terminals to be located in the partition wall and embedded in the partition wall.

According to the above construction, even if water having entered a wire strand portion of one divided wire harness (e.g. wire harness having the second connector mounted on its end) infiltrates through clearances between the strands by a capillary phenomenon and penetrates up to the second connector fitting portion of the intermediate connector via the terminal on the wire end, water penetration into the first connector fitting portion is made impossible by the waterproofing agent filled in the part in contact with the partition wall portion or the waterproofing agent applied to the intermediate terminal. Namely, since the intermediate terminal is embedded in the waterproofing agent or the waterproofing agent is applied to the intermediate terminal, water cannot penetrate into the first connector fitting portion along the intermediate terminal, wherefore the water cannot penetrate into clearances between wire strands of the other wire harness having the first connector mounted on its end.

In other words, according to the above construction, even if water enters the wire strand portion of one wire harness connected to the devices and infiltrates through the clearances between the strands, the flow of the water is blocked by the intermediate connector, wherefore penetration of the water into the other wire harness connected via the intermediate connector and further into the electronic control unit connected to the other wire harness can be effectively prevented.

Further, since the parts of the intermediate terminals except the electrical contact portions are embedded in the waterproofing agent or have the waterproofing agent applied thereto and the electrical contact portions are projecting as described above, electrical connection between terminals can be reliably maintained while a water stop effect by the waterproofing agent is improved.

Preferably, the both ends of each intermediate terminal to be mounted in the intermediate connector are narrow and long flat plates including the electrical contact portions which are male terminal portions and female terminals are connected to wire ends of the divided wire harnesses and inserted and locked in the first and second connectors, or each intermediate terminal includes a male terminal portion at one end and a female terminal portion at the other end, female terminal portions to be connected to the male terminal portions and male terminal portions to be connected to the female terminal portions are provided at the wire ends to be inserted and locked in the first and second connectors.

Particularly, in terms of improving the water stop effect in the clearances between the strands, it is preferable that both ends of the intermediate terminals are formed into male terminal portions and that the waterproofing agent is filled in the parts of the first and second connector fitting portions, into which the male terminal portions project, in contact with the partition wall portion.

However, the shape of the intermediate terminals is not limited to the above one and, for example, female terminal portions may be provided at both ends.

A third embodiment is directed to a water stop structure for a wire harness for connecting an electronic control unit installed in an automotive vehicle or a motorcycle and devices. The wire harness includes a divided portion for connection of waterproof connectors, terminals including electrical contact portions connectable with each other are crimped and connected to both ends of wires of the divided wire harnesses, and the wire harness includes a first connector and a second connector, into which the terminals are inserted to be locked. A waterproofing agent is filled in either one or both of the first and second connectors to embed parts of the terminals including wire crimping portions, but excluding the electrical contact portions therein.

As described above, in the third embodiments, the intermediate connector is not provided unlike the first invention and the first and second connectors mounted on the ends of the respective divided wire harnesses are directly connected. Further, the waterproofing agent is filled in either one or both of the first and second connectors to embed the parts of the terminals including the wire crimping portions, but excluding the electrical contact portions therein.

According to the above construction, even if water enters a wire strand portion of, for example, one divided wire harness having the second connector mounted on its end and infiltrates through clearances between strands by the capillary phenomenon, the water cannot reach the electrical contact portion in the second connector because of the waterproofing agent filled in the second connector at the end. If the waterproofing agent is filled not in the second connector, but in the first connector, the water can reach up to the electrical contact portion of the terminal of the first connector connected with the second connector, but cannot penetrate to clearances between wire strands of the other wire harness, to which the terminal is crimped and connected, by the waterproofing agent filled in the first connector. Namely, since the wire crimping portion of the terminal is embedded in the waterproofing agent filled in either one or both of the first and second connectors, water cannot move along the wire crimping portion, wherefore water having infiltrated through clearances between wire strands of the one divided wire harness cannot penetrate to clearances between wire strands of the other divided wire harness via the wire crimping portion.

In other words, according to the above construction, even if water enters the wire strand portion of one wire harness connected to the devices and infiltrates through the clearances between the strands, the flow of the water is blocked by the first connector at the end or/and by the first connector connected with the first connector. Therefore, penetration of the water into clearances between wire strands of the other wire harness connected ahead and into the electronic control unit connected to the other wire harness can be effectively prevented.

Further, according to the above construction, it is possible to prevent penetration of not only water having infiltrated through the clearances between the wire strands of the wire harness, but also water from the outside of the connectors.

Since the parts of the terminals including the wire crimping portions, but excluding the electrical contact portions are embedded in the waterproofing agent and the electrical contact portions are projecting also in the third invention, electrical connection between the terminals can be reliably maintained while the water stop effect by the waterproofing agent is improved.

A fourth embodiment is directed to a water stop structure for a wire harness for connecting an electronic control unit installed in an automotive vehicle or a motorcycle and devices. An intermediate connector is provided which is to be connected with a connector in a housing of the electronic control unit by being fitted into a connector connection port formed in the housing. A first connector fitting portion, into which the connector is to be fitted, and a second connector fitting portion, into which a wire harness side connector connected with an end of the wire harness is to be fitted, is partitioned by a partition wall portion in the intermediate connector. Intermediate terminals are inserted through the partition wall portion of the intermediate connector, electrical contact portions at both ends of each intermediate terminal project into the first and second connector fitting portions, and a waterproofing agent is filled in a part of either one or both of the first and second connector fitting portions in contact with the partition wall portion to embed parts of the intermediate terminals except the electrical contact portions therein.

As described above, the connector formed in the housing of the electronic control unit and the connector connected to the end of the wire harness are connected via the intermediate connector. Further, the intermediate connector includes the partition wall portion that partitions the first connector fitting portion, into which the connector of the electronic control unit is to be fitted, and the second connector fitting portion, into which the wire harness side connector is to be fitted, and has the intermediate terminals to be connected to the terminals of the respective connectors inserted therethrough. The waterproofing agent is filled in the part of the either one or both of the first and second connector fitting portions in contact with the partition wall portion to embed the parts of the intermediate terminals except the electrical contact portions therein.

According to the above construction, even if water having entered a wire strand portion due to a damage or the like of an insulated portion of a wire constituting the wire harness infiltrates through clearances between strands by the capillary phenomenon and penetrates up to the second connector fitting portion of the intermediate connector via the terminal at the wire end, water penetration into the first connector fitting portion, into which the connector of the electronic control unit is fitted, is made impossible by the waterproofing agent filled in the part in contact with the partition wall portion. In other words, since the intermediate terminal is embedded in the waterproofing agent, water cannot penetrate into the first connector fitting portion along the intermediate terminal. Therefore, water penetration into the electronic control unit can be prevented.

Further, since the parts of the intermediate terminals except the electrical contact portions are embedded in the waterproofing agent and the electrical contact portions are projecting as described above, electrical connection between the terminals can be reliably maintained while the water stop effect by the waterproofing agent is improved.

Preferably, each intermediate terminal to be mounted in the intermediate connector has one end thereof projecting into the first connector fitting portion formed into a female terminal portion and the other end thereof projecting into the second connector fitting portion formed into a male terminal portion. Additionally, the connector in the electronic control unit preferably is a board mounting connector, male terminal portions of the board mounting connector are connected to the female terminal portions and female terminal portions of the wire harness side connector are connected to the male terminal portions.

The both ends of each intermediate terminal are formed into the female and male terminals as described above for the following reason. Since terminals of the board mounting connector of the electronic control unit are normally tab-shaped male terminals, one ends of the intermediate terminals of the intermediate connector connected to the male terminals are formed into female terminals. If the both ends of the intermediate terminals are female terminals, through holes have to be enlarged for the insertion of the intermediate terminals through the partition wall. Therefore, the other ends of the intermediate terminals are formed into male terminals.

Note that the through holes may be enlarged and the both ends may be formed into female terminals.

In either case, the intermediate terminals are positioned and held by being engaged with locking portions provided at inner surfaces of terminal accommodating chambers of the intermediate connector.

Preferably, the intermediate connector is constructed such that upper and lower walls of the second connector fitting portion project at positions more outward than upper and lower walls of the first connector fitting portion to make a cross sectional area of the second connector fitting portion larger than that of the first connector fitting portion, the partition wall is provided in the second connector fitting portion and the waterproofing agent is filled in the second connector fitting portion in contact with the partition wall. The first connector fitting portion projects into the housing of the electronic control unit, and the second connector fitting portion projects out from the housing.

By causing the first connector fitting portion to project into the housing of the electronic control unit and causing the second connector fitting portion, whose upper and lower walls project at the positions more outward than the upper and lower walls of the first connector fitting portion to make the cross sectional area of the second connector fitting portion larger than that of the first connector fitting portion, to project out from the housing as described above, the connector connection port of the electronic control unit can be completely closed by the second connector fitting portion having a large cross sectional area. Therefore, it is possible to prevent penetration of water and dust into the electronic control unit through the connector connection port and improve a waterproof effect and a dust-proof effect.

Further, by providing the partition wall portion in the second connector fitting portion caused to project out from the housing of the electronic control unit and filling the waterproofing agent in the second connector fitting portion in contact with the partition wall portion as described above, water can be blocked by the waterproofing agent outside the housing of the electronic control unit and water penetration into the electronic control unit can be reliably prevented.

The waterproofing agent used in the first to fourth embodiments is preferably a gel-like sealant or a liquid potting sealant, and filled and cured in a terminal mounting area in the housing of the intermediate connector or the first or second connector.

As described above, by filling and curing the gel-like sealant or liquid potting sealant as the waterproofing agent in the terminal mounting area in the housing of the intermediate connector or the first or second connector, the gel-like sealant or liquid potting sealant having good water resistance, heat resistance, insulating property and the like is held in close contact with the embedded intermediate terminals and wire crimping portions without exerting a large load, whereby the water stop effect can be improved.

A silicone gel, butyl rubber and the like are, for example, preferably used as the gel-like sealant. Further, epoxy resin and the like are, for example, preferably used as the liquid potting sealant.

Preferably, the electronic control unit is one or more selected from an engine control unit, a fuel injection control unit, an ABS control unit, an airbag control unit, a running safety control unit, a vehicle radar control unit and a night-vision camera unit. The devices connected to the electronic control unit are: one or more controllable devices selected from a light, a washer, a door lock, an anti-theft horn and a starter which are controlled by the electronic control unit, information transmitters including sensors such as an $O_2$ sensor, a speed sensor and a knock sensor, which are adapted to transmit information to the electronic control unit, and/or another electronic control unit, and one or more electrical components selected from a fuse, a relay, a connector and a ground member of an electrical connection box.

The above devices are often arranged in a water susceptible area such as an engine compartment, and a wire harness connected to these is also often passed through the water susceptible area. Accordingly, in the case of dividing the wire harness connecting the electronic control unit and the devices and the wire harness connected to the electronic control unit, application of the water stop structure of the present invention is effective in reliably blocking water having infiltrated through clearances between wire strands of the wire harness connected to the devices and preventing penetration of the water into the electronic control unit.

As described above, according to the first and second embodiments, even if water enters the wire strand portion of one divided wire harness connected to the devices, infiltrates through the clearances between the strands and penetrates up to the second connector fitting portion of the intermediate connector via the terminal in the second connector at the end, water penetration into the first connector fitting portion along the intermediate terminal is made impossible by the waterproofing agent filled in the part in contact with the partition wall portion. This can prevent penetration of the water into the other wire harness having the first connector mounted thereon and further into the electronic control unit connected to the other wire harness.

Since the parts of the intermediate terminals except the electrical contact portions are embedded in the waterproofing agent and the electrical contact portions are projecting as described above, electrical connection between the terminals can be reliably maintained while the water stop effect by the waterproofing agent is improved.

Also in the case where no intermediate connector is provided and the first and second connectors provided at the ends of the respective divided wire harnesses are directly connected as in the third invention, even if water enters the wire strand portion of one divided wire harness connected to the devices and infiltrates through the clearances between the strands, the flow of the water is blocked by the waterproofing agent in the second connector at the end or/and the first connector connected with the second connector. Therefore, the water cannot penetrate to the wire strand portion of the other wire harness via the wire crimping portion. Therefore, penetration of the water into the electronic control unit connected to the other wire harness can also be effectively prevented. Further, it is possible to prevent penetration of not only water having infiltrated through the clearances between the wire strands of the wire harness, but also water from the outside of the connectors.

Since the parts of the terminals including the wire crimping portions, but excluding the electrical contact portions are embedded in the waterproofing agent and the electrical contact portions are projecting also in the third invention, electrical connection between the terminals can be reliably maintained while the water stop effect by the waterproofing agent is improved.

Also in the case of connecting the connector formed in the housing of the electronic control unit and the connector connected to the end of the wire harness with the intermediate connector in the fourth invention, even if water having entered the strand portion of the wire constituting the wire harness infiltrates through the clearances between the strands and penetrates up to the second connector fitting portion of the intermediate connector via the terminal at the wire end, water penetration into the first connector fitting portion, into which the connector of the electronic control unit is fitted, is made impossible by the waterproofing agent filled in the part in contact with the partition wall portion. Therefore, water penetration into the electronic control unit can be prevented.

Further, since the parts of the intermediate terminals except the electrical contact portions are embedded in the waterproofing agent and the electrical contact portions are projecting also in the third invention, electrical connection between the terminals can be reliably maintained while the water stop effect by the waterproofing agent is improved.

Furthermore, by filling and curing the gel-like sealant or liquid potting sealant as the waterproofing agent in the housing of the first or second connector or in the terminal mounting area of the intermediate connector in the first to fourth inventions, the gel-like sealant or liquid potting sealant having good water resistance, heat resistance, insulating property and the like is held in close contact with the embedded intermediate terminals without exerting a large load, whereby water penetration can be effectively prevented.

DETAILED DESCRIPTION OF THE PREFERRED EMBODIMENTS

Hereinafter, embodiments of the present invention are described in detail with reference to the drawings.

Figure 1:
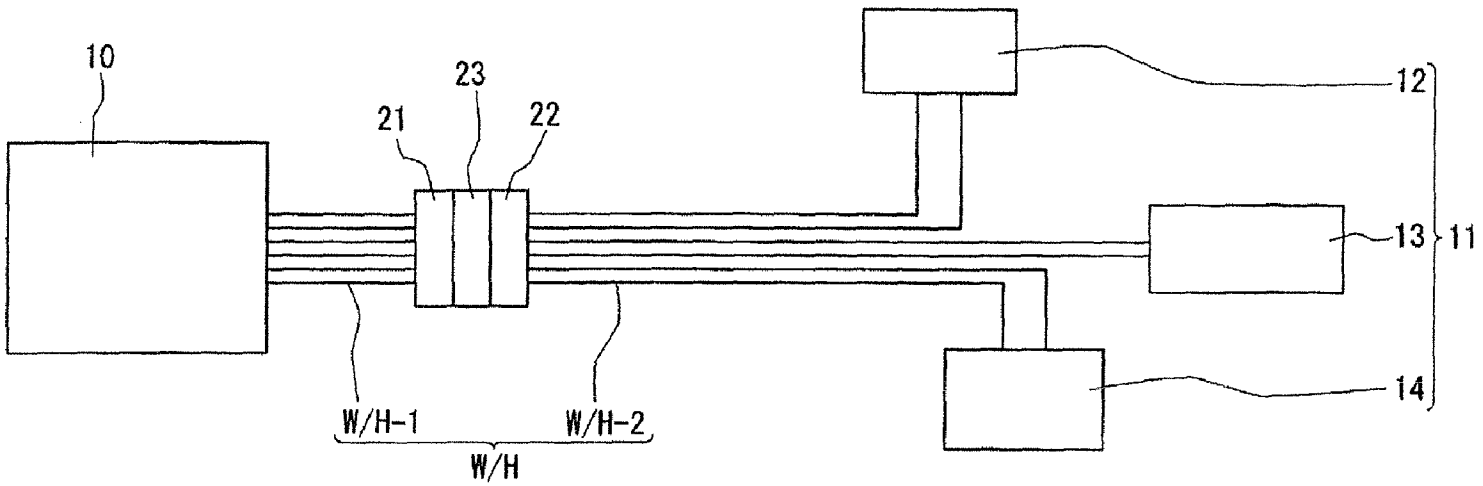
FIG. 1 is a conceptual diagram showing a connected state of a wire harness with an electronic control unit and devices in a first embodiment.
Figure 2:
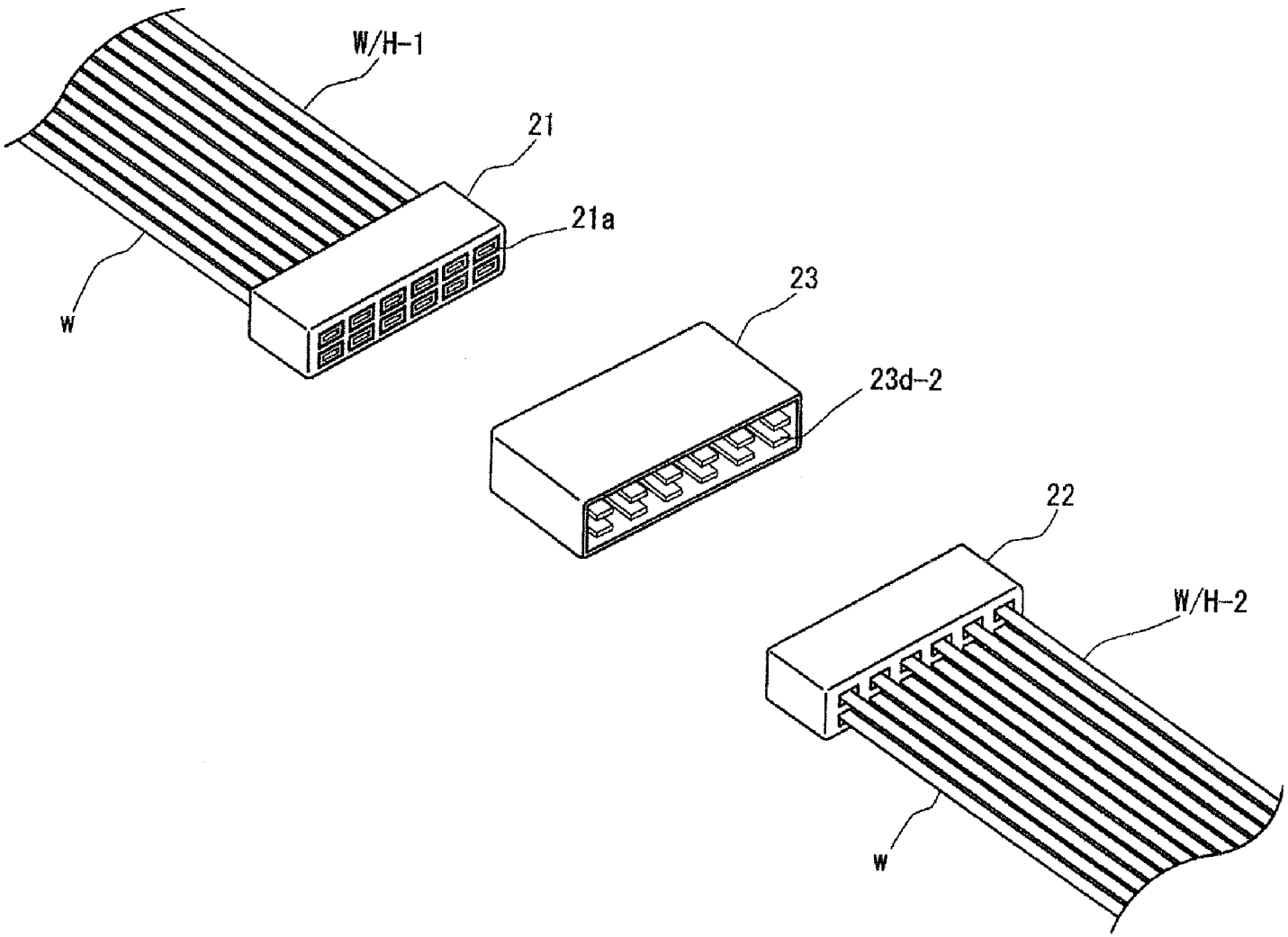
FIG. 2 is a schematic perspective view of a first connector and a second connector to be connected with an intermediate connector of the first embodiment.
Figure 3:
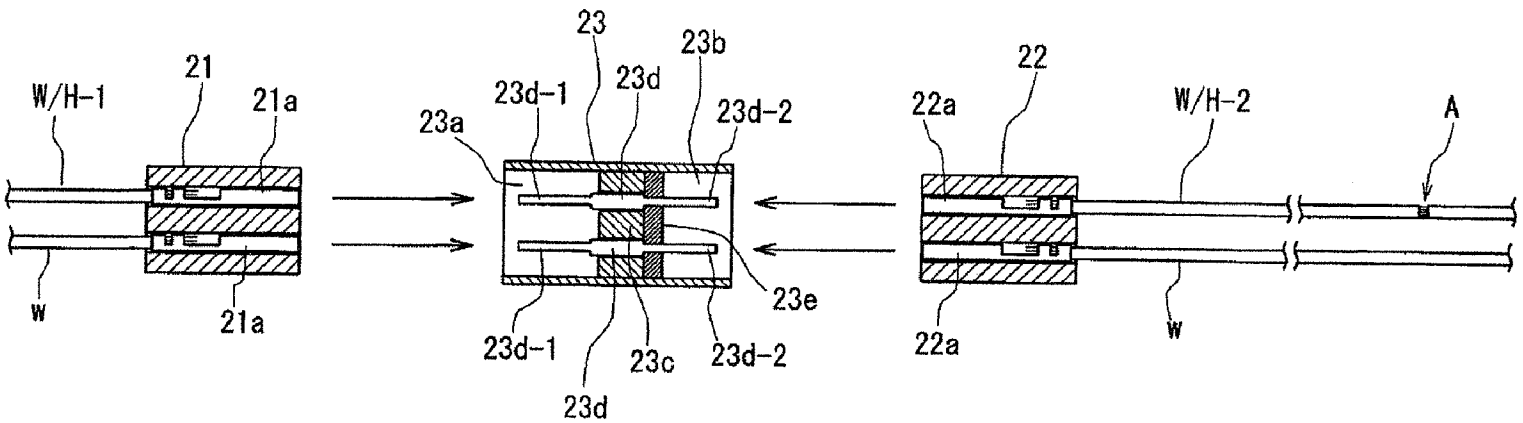
FIG. 3 is a schematic perspective view of the first and second connectors to be connected with the intermediate connector.

FIGS. 1 to 3 show a water stop structure of a wire harness W/H connecting an electronic control unit 10 and devices 11 in a first embodiment.

The electronic control unit 10 installed in an automotive vehicle or a motorcycle controls controllable devices 13 based on signals received from information transmitters 12 such as sensors. As shown in FIG. 1, the electronic control unit 10 is connected to the devices 11 including the information transmitters 12, the controllable devices 13 and an electrical component 14 such as a fuse box connected to a power supply by the wire harness W/H. Note that the wire harness W/H passes through a water susceptible area of the vehicle.

The electronic control unit 10 may be, for example, an engine control unit, a fuel injection control unit, an airbag control unit, a running safety control unit or the like.

As described above, the devices 11 include the information transmitters 12, the controllable device 13 and the electrical component 14. The information transmitters 12 include, for example, an $O_2$ sensor, a speed sensor, a knock sensor and another electronic control unit although they differ depending on the type of the electronic control unit 10.

The controllable devices 13 include, for example, a light, a washer, a door lock, an anti-theft horn although they differ depending on the type of the electronic control unit 10.

Further, the electrical components 14 include, for example, a fuse, a relay, a connector, a ground member of an electrical connection box.

As shown in FIG. 1, the wire harness W/H for connecting the electronic control unit 10 and the devices 11 is divided into a unit side wire harness W/H-1 to be connected to the electronic control unit 10 and a device side wire harness W/H-2 to be connected with the devices 11. Note that the wire harness W/H is arranged in such a place where damage and the like of wires do not occur in the unit side wire harness W/H-1 and water does not penetrate into wire strand portions.

As shown in FIGS. 2 and 3, female terminal portions 21*a*, 22*a* are respectively connected to ends of wires of the divided unit side wire harness W/H-1 and device side wire harness W/H-2 and inserted and locked in a first connector 21 and a second connector 22. Further, the first connector 21 at an end of the unit side wire harness W/H and the second connector 22 at an end of the device side wire harness W/H are connected via an intermediate connector 23.

The intermediate connector 23 includes a first connector fitting portion 23*a*, into which the first connector 21 is to be fitted, and a second connector fitting portion 23*b*, into which the second connector 22 is to be fitted. The first and second connector fitting portions 23*a*, 23*b* are partitioned by a partition wall portion 23*c*. A plurality of intermediate terminals 23*d* are inserted through the partition wall portion 23*c*, and electrical contact portions at the opposite ends thereof are male terminal portions 23*d*-1, 23*d*-2 in the form of narrow and long flat plates. In other words, the male terminal portion 23*d*-1 at one end of each intermediate terminal 23*d* projecting into the first connector fitting portion 23*a* is connected to the female terminal portion 21*a* of the first connector 21, whereas the male terminal portion 23*d*-2 at the other end of each intermediate terminal 23*d* projecting into the second connector fitting portion 23*b* is connected to the female terminal portion 22*a* of the second connector 22.

A terminal mounting area of the second connector fitting portion 23*b* in contact with the partition wall portion 23*c* is filled with a gel-like sealant containing a silicone gel as a waterproofing agent 23*e*. The intermediate terminals 23*d* projecting into the second connector fitting portion 23*b* are embedded in the waterproofing agent 23*e* except at electrical contact portions 23*d*-2.

Although the waterproofing agent 23*e* is filled in a part of the second connector fitting portion 23*b* in contact with the partition wall portion 23*c* in this embodiment, it may be filled in the first connector fitting portion 23*a* or may be filled in both first and second connector fitting portions 23*a*, 23*b*.

The silicone gel sealant 23*e* filled in the terminal mounting area of the second connector fitting portion 23*b* in contact with the partition wall portion 23*c* is formed by injecting liquid silicone oil into this area and curing it.

The electronic control unit 10 and the devices 11 can be electrically connected (FIG. 3) by fitting the first connector 21 at the end of the unit side wire harness W/H-1 into the first connector fitting portion 23*a* of the intermediate connector 23 and fitting the second connector 22 at the end of the device side wire harness W/H-2 into the second connector fitting portion 23*b* of the intermediate connector 23.

As described above, in this embodiment, the wire harness W/H for connecting the electronic control unit 10 and the devices 11 is divided, and the first connector 21 at the end of the divided unit side wire harness W/H-1 and the second connector 22 at the end of the device side wire harness W/H-2 are connected via the intermediate connector 23. Further, the intermediate connector 23 includes the partition wall portion 23*c* adapted to partition the first and second connector fitting portions 23*a*, 23*b*, into which the first and second connectors 21, 22 are fitted, and having the intermediate terminals 23*d* inserted therethrough, and the waterproofing agent 23*e* is filled in the part of the second connector fitting portion 23*b* in contact with the partition wall portion 23*c*.

By the above construction, even if water having entered a strand portion from a damaged part A where a part of an insulation coating portion of a wire w constituting the device side wire harness W/H-2 is peeled off infiltrates through clearances between strands and penetrates up to the second connector fitting portion 23*b* of the intermediate connector 23 via the terminal 22*a* at the wire end, water penetration into the second connector fitting portion 23*a* is made impossible by the waterproofing agent 23*e* filled in the part of the second connector fitting portion 23*b* in contact with the partition wall portion 23*c*. This can prevent water penetration into the unit side wire harness W/H-1 having the first connector 21 mounted thereon and further into the electronic control unit 10 connected with the wire harness W/H-1.

Since the parts of the intermediate terminals 23*d* except the electrical contact portions 23*d*-2 are embedded in the waterproofing agent 23*e* and the electrical contact portions 23*d*-2 are projecting as described above, electrical connection between the terminals can be reliably maintained while a water stop effect by the waterproofing agent 23*e* is improved.

Further, by filling and curing the gel-like sealant as the waterproofing agent 23*e* in the terminal mounting area in contact with the partition wall portion 23*c* as described above, the gel-like sealant 23*e* having good water resistance, heat resistance, insulating property and the like is held in close contact with the embedded intermediate terminals 23*d* without exerting a large load, whereby the water stop effect can be improved.

Figure 4:
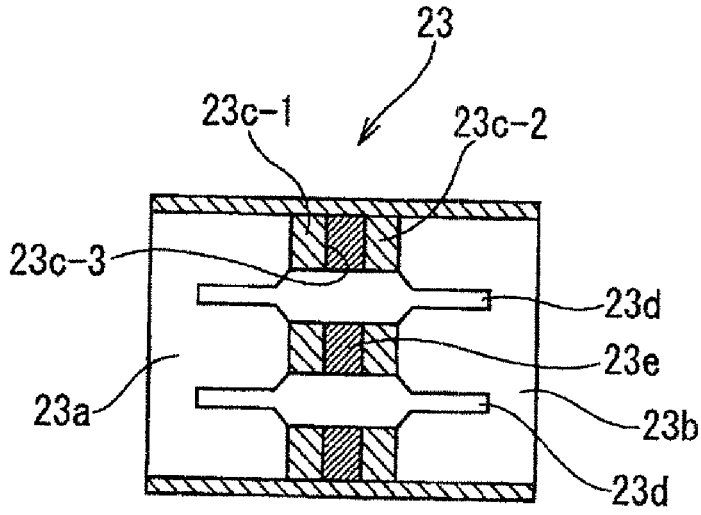
FIG. 4 is a section showing an essential part of a modification of the first embodiment.

FIG. 4 shows a modification of the first embodiment.

In this modification, the partition wall portion 23*c* of the intermediate connector 23 is divided into two partition wall portions 23*c*-1, 23*c*-2, a clearance 23*c*-3 is provided between the partition wall portions 23*c*-1 and 23*c*-2, and the waterproofing agent 23*e* is filled in the clearance 23-3.

The intermediate terminals 23*d* are inserted through the partition wall portion 23*c*-1, the waterproofing agent 23*e* in the clearance 23*c*-3 and the partition wall portion 23*c*-2, and middle parts of the inserted intermediate terminals 23*d* are located and embedded in the waterproofing agent 23*e*. Since the other construction is same as in the first embodiment, it is neither shown nor described.

When the waterproofing agent 23*e* is filled between the two partition wall portions 23*c*-1 and 23*c*-2 divided as described above, the outflow of the waterproofing agent 23*e* can be prevented and the intermediate terminals 23*d* inserted through the partition wall portions can be reliably inserted through the waterproofing agent 23*e*.

Figure 5:
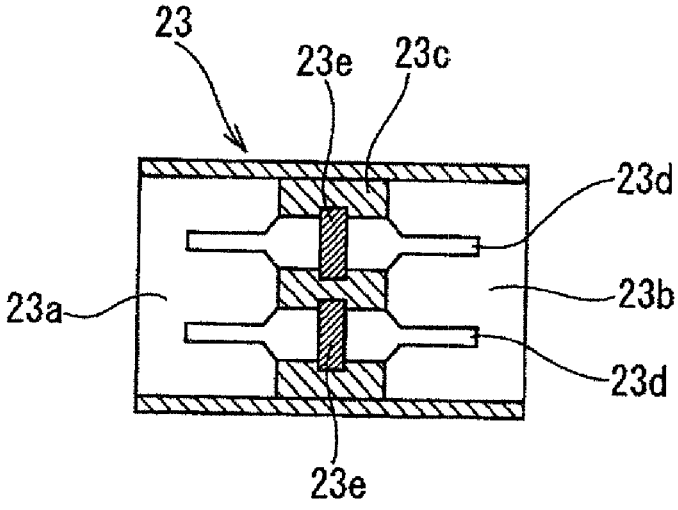
FIG. 5 is a section showing an essential part of a second embodiment.

FIG. 5 shows a second embodiment.

In the second embodiment, instead of filling the waterproofing agent in the part of the intermediate connector 23 in contact with the partition wall portion or in the clearance between the partition wall portions, a waterproofing agent 23*e* is applied to surfaces of middle parts of intermediate terminals 23*d* inserted through a partition wall portion 23*c* beforehand and, in this state, insert molding is carried out with the intermediate terminals 23*d* set in a part, which will become the partition wall 23*c*, thereby forming an intermediate connector 23.

Since the other construction is same as in the first embodiment, it is neither shown nor described.

If the waterproofing agent 23*e* is applied to the surfaces of the intermediate terminals 23*d* beforehand as described above, a process of filling the waterproofing agent 23*e* into a part in contact with the partition wall portion or into a clearance formed in the partition wall portion can be dispensed with. In addition, the waterproofing agent 23*e* on the surfaces of the intermediate terminals 23*d* as inserts in the partition wall portion 23*c* can be reliably held to improve a water stop performance.

Figure 6:
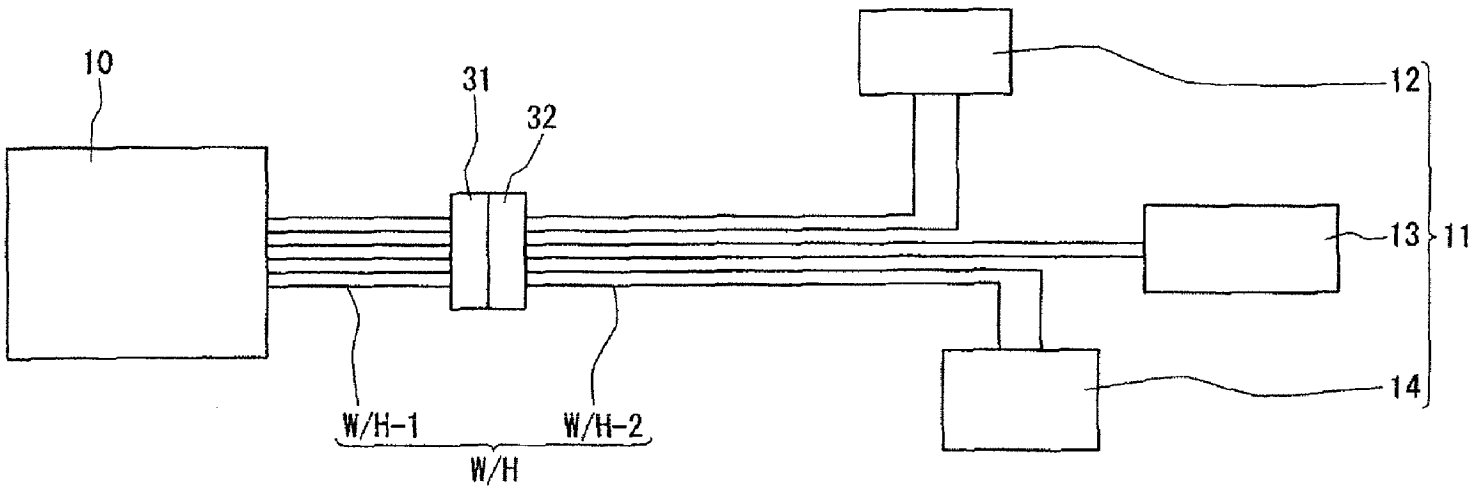
FIG. 6 is a conceptual diagram showing a connected state of a wire harness with an electronic control unit and devices in a third embodiment.
Figure 7:
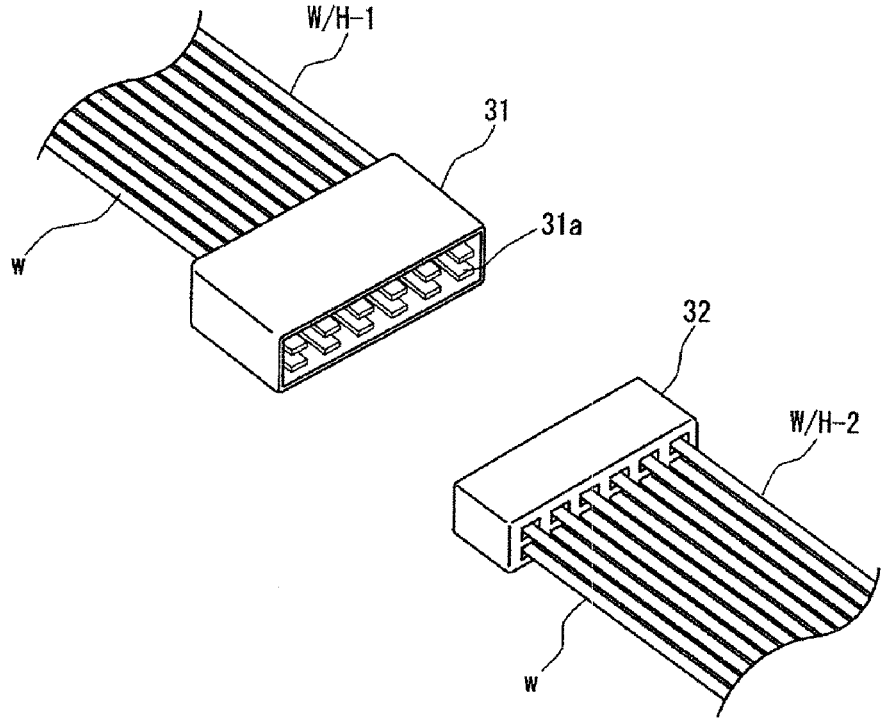
FIG. 7 is a schematic perspective view of a first connector and a second connector to be connected according to the third embodiment.
Figure 8:
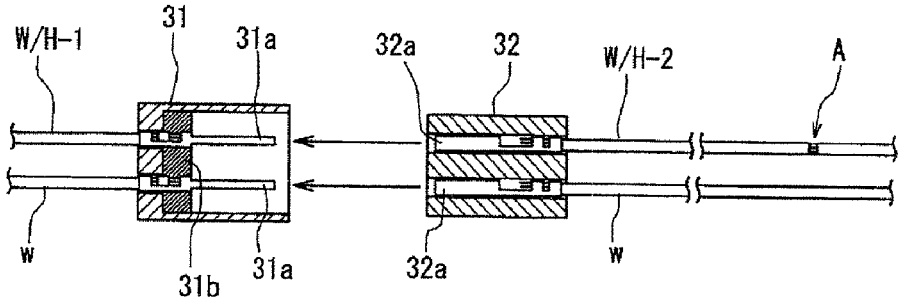
FIG. 8 is a schematic section of the first and second connectors to be connected.
Figure 9:
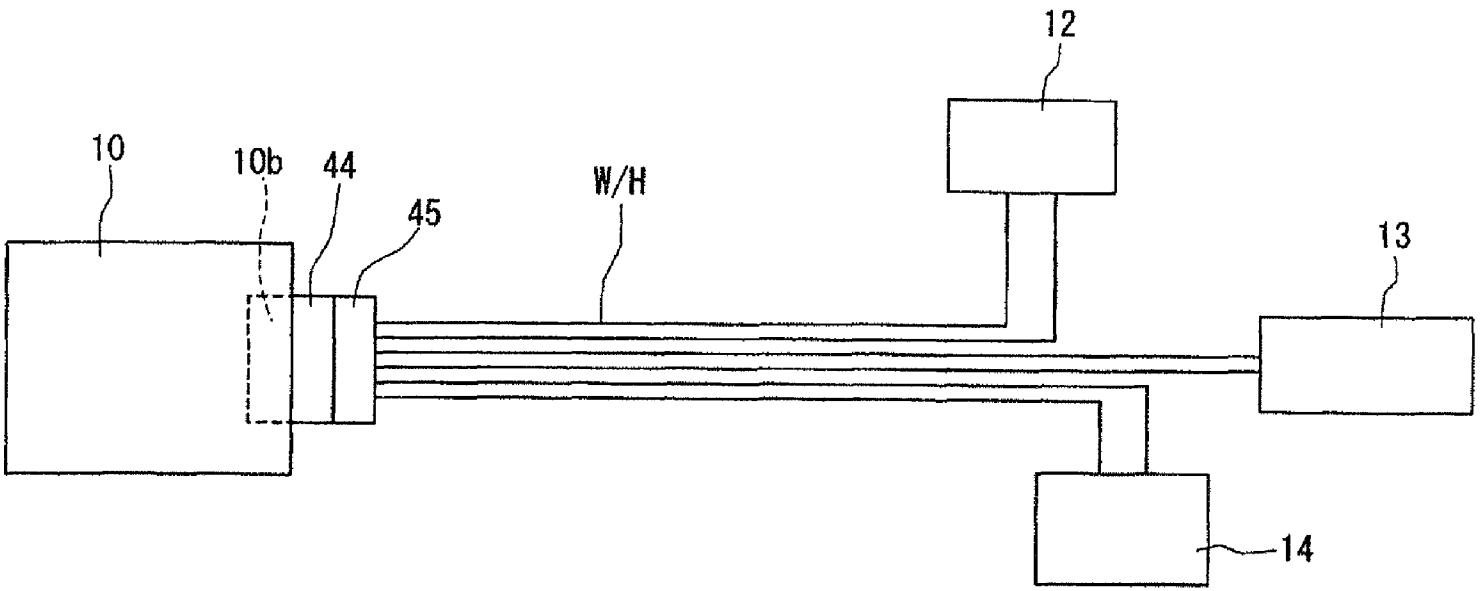
FIG. 9 is a conceptual diagram showing a connected state of a wire harness with an electronic control unit and devices in a fourth embodiment.

FIGS. 6 to 8 show a third embodiment.

In the third embodiment, no intermediate terminals are provided unlike the first and second embodiments, a first connector 31 mounted at an end of a divided unit side wire harness W/H-1 and a second connector 32 mounted at an end of a device side wire harness W/H-2 are directly connected. In this third embodiment, male terminal portions 31*a* are connected to ends of wires of the unit side wire harness W/H-1 and mounted into the first connector 31, whereas female terminal portions 32*a* are connected to ends of wires of the device side wire harness W/H-2 and mounted into the second connector 32. A liquid potting sealant containing epoxy resin is filled as a waterproofing agent 31*b* into the first connector 31 in which the male terminal portions 31*a* are projecting, and parts of the male terminal portions 31*a* including wire crimping portions, but excluding electrical contact portions are embedded in the waterproofing agent 31*b*. The third embodiment is similar to the first embodiment except for the above points.

According to the above construction, if water enters a wire strand portion from a damaged part A of the device side wire harness W/H-2 and infiltrates through clearances between strands by a capillary phenomenon, the water may reach up to the electrical contact portion of the male terminal portion 31*a* of the first connector 31 connected with the female terminal portion 32*a* at the end. However, since the wire crimping portion of the male terminal portion 31*a* is embedded in the waterproofing agent 31*b* filled in the first connector 31, it is possible to prevent water penetration into clearances between strands of the wire of the unit side wire harness W/H-1, to which the male terminal portion 31*a* is crimped and connected, and further into an electronic control unit 10 connected with the wire harness W/H-1.

By filling and curing the liquid potting sealant as the waterproofing agent 31*b* in a terminal mounting area of the first connector 31 as described above, the liquid potting sealant 31*b* having good water resistance, heat resistance, insulating property and the like is held in close contact with the embedded wire crimping portions without exerting a large load, whereby a water stop effect can be improved.

FIGS. 9 to 13 show a water stop structure of a wire harness W/H connected to an electronic control unit 10 according to a fourth embodiment. The electronic control unit 10 and devices 11 (12, 13, 14) are connected via the wire harness, which is passed through a water susceptible area of a vehicle.

Figure 10A:
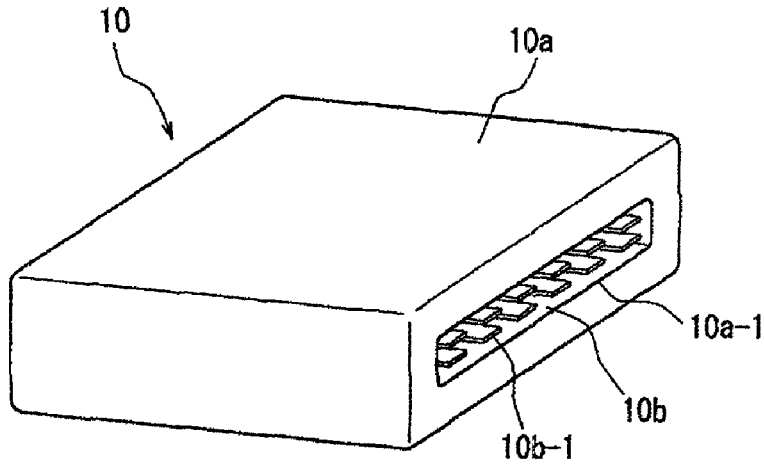
FIGS. 10(A) and 10(B) are a schematic perspective view and a schematic section showing an electronic control unit of a fourth embodiment.
Figure 10B:
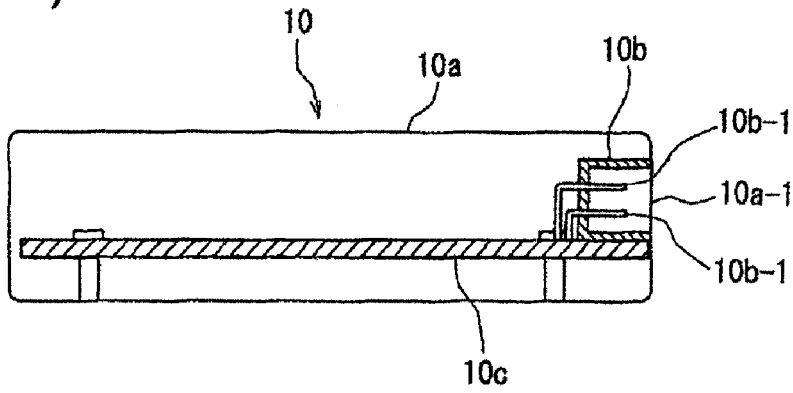

As shown in FIG. 10, a housing 10*a* of the electronic control unit 10 is formed with a connector connection port 10*a*-1, and a board mounting connector 10*b* including male terminal portions 10*b*-1 projecting from a board is provided in the housing 10*a*.

Figure 11A:
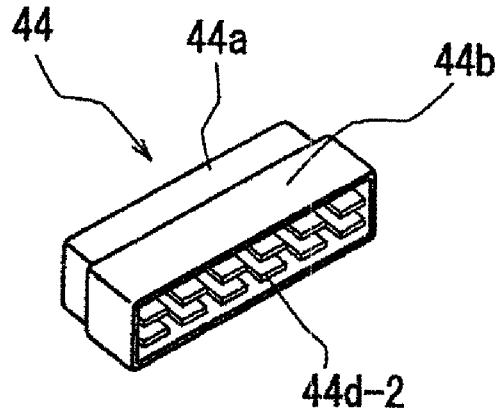
FIGS. 11(A) and 11(B) are a schematic perspective view and a schematic section showing an intermediate connector of the fourth embodiment.
Figure 11B:
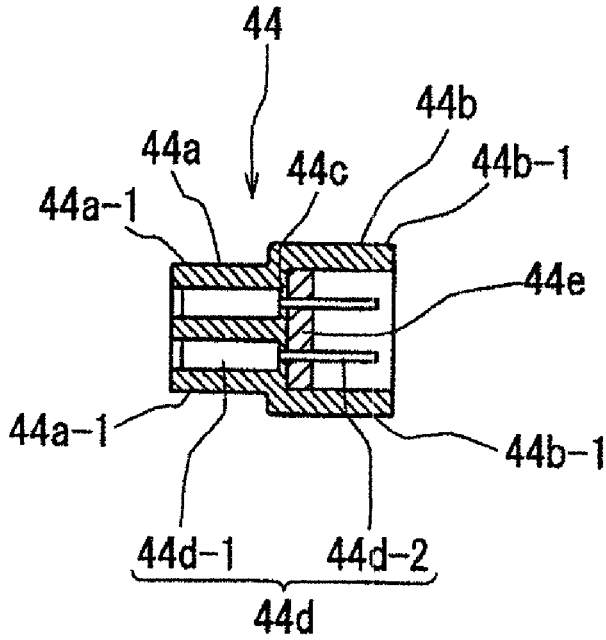
Figure 12A:
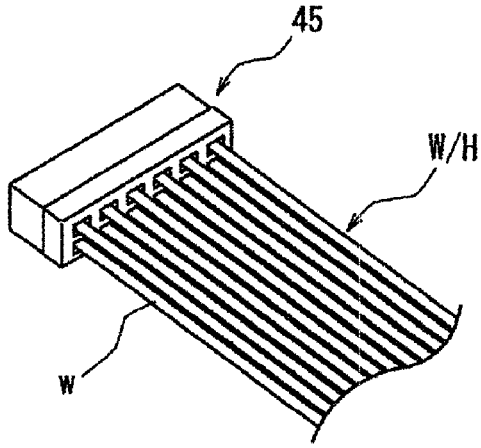
FIGS. 12(A) and 12(B) are a schematic perspective view and a schematic section showing a wire harness side connector of the fourth embodiment.
Figure 12B:
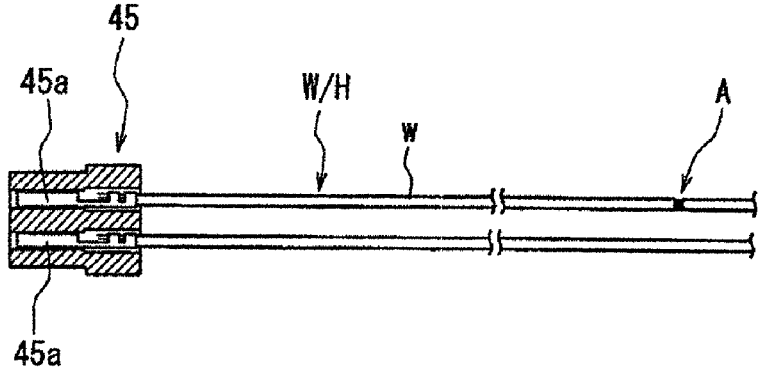

The board mounting connector 10*b* and a connector 45 at an end of the wire harness W/H shown in FIG. 12 are connected with an intermediate connector 44 shown in FIG. 11, whereby the board mounting connector 10*b* and the connector 45 at the end of the wire harness W/H are electrically connected.

Specifically, as shown in FIG. 11, a first connector fitting portion 44*a*, into which the board mounting connector 10*b* is to be fitted, and a second connector fitting portion 44*b*, into which the connector 45 at the end of the wire harness W/H is to be fitted, are provided in a housing of the intermediate connector 44, and the first and second connector fitting portions 44*a*, 44*b* are partitioned by a partition wall portion 44*c*.

A plurality of intermediate terminals 44*d* are inserted through the partition wall portion 44*c* and respectively project into the first and second connector fitting portions 44*a*, 44*b*. One end 44*d*-1 of each intermediate terminal 44*d* projecting into the first connector fitting portion 44*a* is formed into a female terminal portion and connected with the male terminal portion 10*b*-1 of the board mounting connector 10*b*. Another end 44*d*-2 of each intermediate terminal 44*d* projecting into the second connector fitting portion 44*b* is formed into a male terminal portion and connected with a female terminal portion 45*a* of the connector 45 at the end of the wire harness W/H.

The housing of the intermediate connector 44 is so shaped that upper and lower walls 44*b*-1 of the second connector fitting portion 44*b* project at positions more outward than upper and lower walls 44*a*-1 of the first connector fitting portion 44*a* to make a cross sectional area of the second connector fitting portion 44*b* larger than that of the first connector fitting portion 44*a*.

The partition wall portion 44*c* is provided in the second connector fitting portion 44*b* having a larger cross sectional area, and a gel-like sealant containing a silicone gel is filled as a waterproofing agent 44*e* into a terminal mounting area of the second connector fitting portion 44*b*. By fitting the waterproofing agent 44*e*, parts of the intermediate terminals projecting into the second connector fitting portion 44*b* are embedded in the waterproofing agent 44*e* except at electrical contact portions of the male terminals 44*d*-2.

The silicone gel sealant 44*e* filled in the terminal mounting area of the second connector fitting portion 44*b* in contact with the partition wall portion 44*c* is injected into this area in a viscous and liquid state and then naturally cured.

Figure 13:
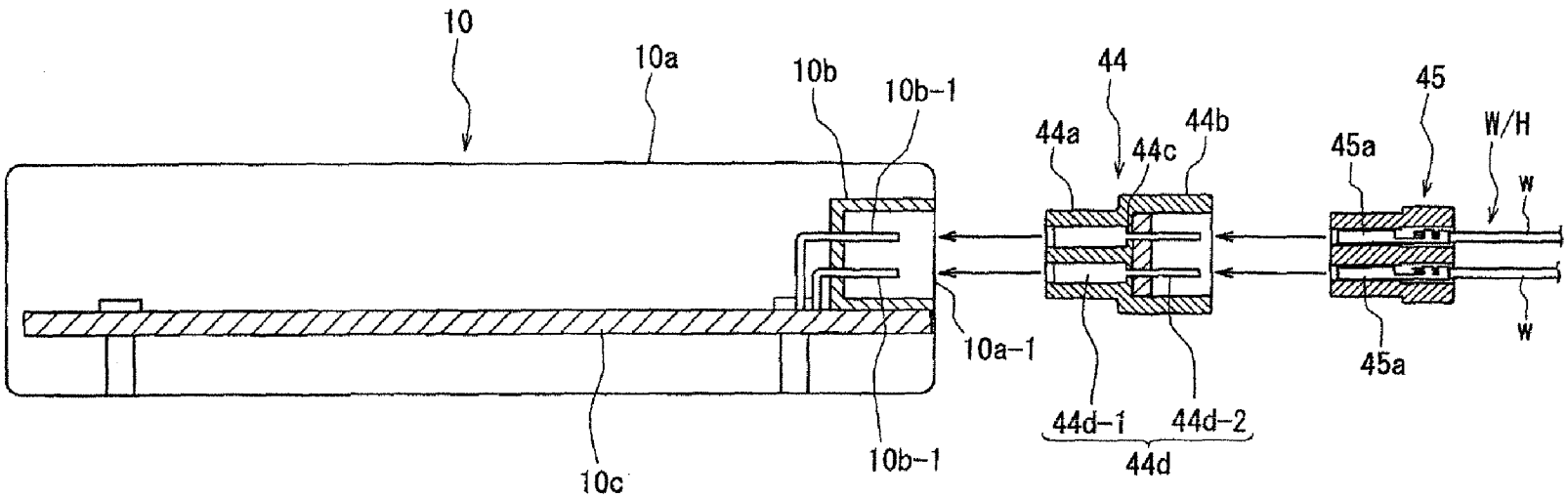
FIG. 13 is a schematic diagram showing a connection process of an electronic control unit side connector and the intermediate connector and that of the intermediate connector and the wire harness side connector.
Figure 14:
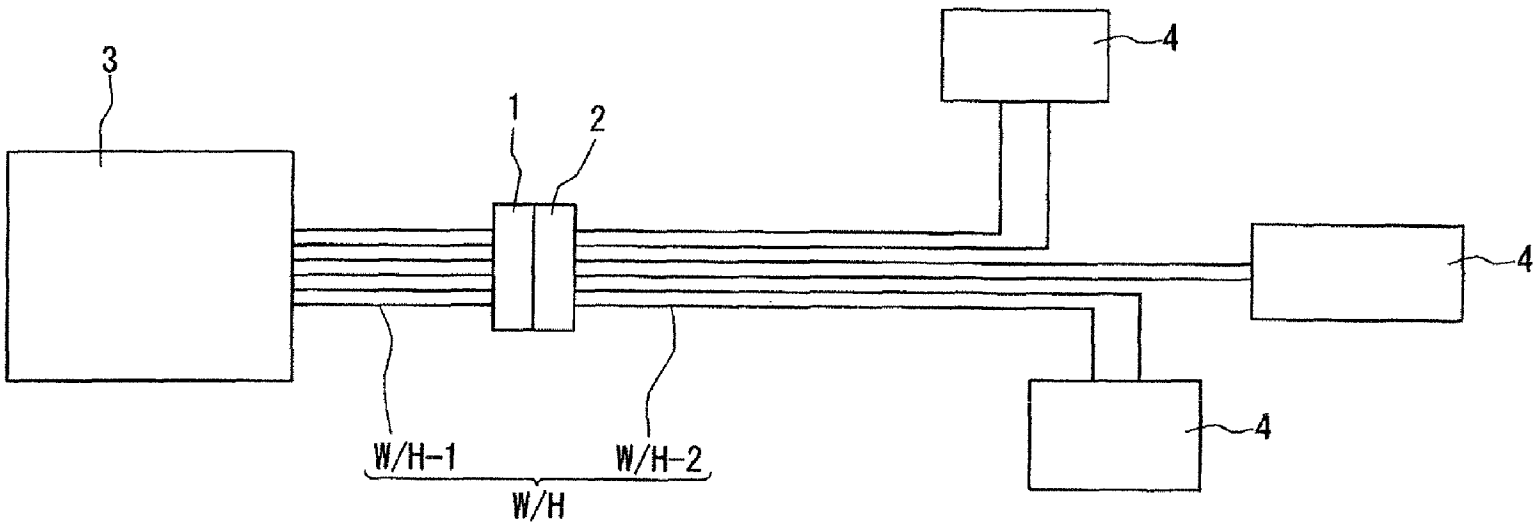
FIG. 14 PRIOR ART
FIG. 14 is a diagram showing a prior art
Figure 15:
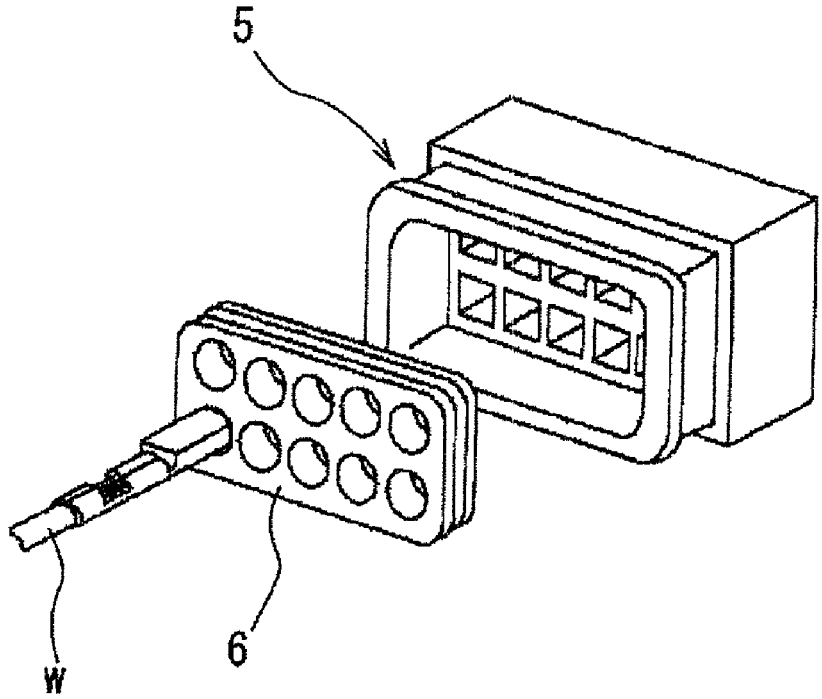
FIG. 15 PRIOR ART
FIG. 15 is a diagram showing a prior art.

The first connector fitting portion 44*a* of the intermediate connector 44 is caused to project into the housing 10*a* through the connector connection port 10*a*-1 of the electronic control unit 10 and connected with the board mounting connector 10*b* inside. On the other hand, the second connector fitting portion 44*b* of the intermediate connector 44 projecting out from the housing is connected with the connector 45 at the end of the wire harness W/H, whereby the electronic control unit 10 and the wire harness W/H can be electrically connected (FIG. 13).

As described above, in this fourth embodiment, the board mounting connector 10*b* formed in the housing 10*a* of the electronic control unit 10 and the connector 45 connected at the end of the wire harness W/H are connected with the intermediate connector 44. Further, the intermediate connector 44 includes the partition wall portion 44*c* that partitions the first connector fitting portion 44*a*, into which the connector 10*b* of the electronic control unit 10 is to be fitted, and the second connector fitting portion 44*b*, into which the connector 45 of the wire harness W/H is to be fitted, and has the intermediate terminals 44*d* inserted therethrough, and the waterproofing agent 44*e* containing the gel-like sealant is filled in the part of the second connector fitting portion 44*b* in contact with the partition wall portion 44*c*.

By the above construction, even if water having entered a strand portion from a damaged part A where a part of an insulation coating of a wire w constituting the wire harness W/H is peeled off infiltrates through clearances between strands and penetrates up to the second connector fitting portion 44*b* of the intermediate connector 44 via the terminal 45*a* at the wire end, water penetration into the first connector fitting portion 44*a*, into which the connector 10*b* of the electronic control unit 10 is fitted, is made impossible by the waterproofing agent 44*e* filled in the part in contact with the partition wall portion 44*c*. Therefore, water penetration into the electronic control unit 10 can be prevented.

Further, since the male terminals 44*d*-2 of the intermediate terminals projecting into the second connector fitting portion 44*b* are embedded in the waterproofing agent 44*e* except at the electrical contact portions and the electrical contact portions are projecting as described above, electrical connection between the terminals can be reliably maintained while a water stop effect by the waterproofing agent 44*e* is improved.

Further, by filling the gel-like sealant as the waterproofing agent 23*e* as described above, the gel-like sealant 44*e* having good water resistance, heat resistance, insulating property and the like is held in close contact with the embedded intermediate terminals 44*d*-2 without exerting a large load, whereby water penetration from the second connector fitting portion 44*b* to the first connector fitting portion 44*a* can be effectively prevented.

Further, as described above, by causing the first connector fitting portion 44*a* to project into the housing 10*a* of the electronic control unit 10 and causing the second connector fitting portion 44*b* having a larger cross section area than the first connector fitting portion 44*a* because of the upper and lower walls 44*b*-1 projecting at the positions more outward than the upper and lower walls 44*a*-1 of the first connector fitting portion 44*a* to project out from the housing 10*a*, the connector connection port 10*a*-1 of the electronic control unit 10 can be completely closed by the second connector fitting portion 44*b* having a large cross sectional area. Therefore, penetration of water and dust into the electronic control unit 10 through the connector connection port 10*a*-1 can be prevented, whereby a waterproof effect and a dust-proof effect can be improved.

A fifth embodiment (not shown) is similar to the fourth embodiment except that a liquid potting sealant containing epoxy resin is used as a waterproofing agent 44*e*, filled and cured.

Effects similar to those of the fourth embodiment are obtained also in the fifth embodiment, and penetration of water having infiltrated through clearances between strands of a wire w constituting a wire harness W/H into an electronic control unit 10 can be effectively prevented by filling the potting sealant 44*e* into a part of an intermediate connector 44 in contact with a partition wall portion 44*c*.

What is claimed is:

1. A water stop structure for a wire harness for connecting an electronic control unit installed in an automotive vehicle or a motorcycle and devices, characterized in that:

the wire harness is divided in an arrangement direction into a first wire harness section for connection to the electronic control unit and a second wire harness section for connection to the devices, terminals are respectively connected to both ends of wires of the divided wire harnesses, the terminals of the first wire harness section opposite the electronic control unit being mounted into a first connector and the terminals of the second wire harness section opposite the devices being mounted into a second connector, an intermediate connector is provided which includes an outer tube having opposite first and second ends, a first connector fitting portion adjacent the first end of the outer tube and a second connector fitting portion adjacent the second end of the outer tube, into which the first and second connectors are respectively to be fitted, and a partition wall portion formed from a resin material and disposed in the outer tube between the first and second connector fitting portions, intermediate terminals are inserted through the partition wall portion of the intermediate connector and electrical contact portions at both ends of the respective intermediate terminals project into the first and second connector fitting portions, and a waterproofing agent is applied to parts of the intermediate terminals to be located in the partition wall beforehand and embedded in the partition wall by insert molding so that the waterproofing agent on each of the intermediate terminals is spaced from the waterproofing agent on each other one of the intermediate terminals, the waterproofing agent on each of the intermediate terminals being surrounded and engaged by the resin on the partition wall.

2. A water stop structure for a wire harness for connecting an electronic control unit installed in an automotive vehicle or a motorcycle and devices, characterized in that:

an intermediate connector is provided which is to be connected with an electronic control unit connector in a housing of the electronic control unit by being fitted into a connector connection port formed in the housing of the electronic control unit, the intermediate connector having a first connector fitting portion, into which the electronic control unit connector is to be fitted, and a second connector fitting portion having a tubular side wall into which a wire harness side connector connected with an end of the wire harness is to be fitted, is the intermediate connector being partitioned by a partition wall portion in the intermediate connector, the partition wall portion having a first surface facing the first connector fitting portion and a second surface facing the second connector fitting portion, and intermediate terminals are inserted through the partition wall portion of the intermediate connector, electrical contact portions at both ends of each intermediate terminal project into the first and second connector fitting portions, and a waterproofing agent is filled in a part of the second connector fitting portions and cured in place in contact with a circumferentially continuous part of the tubular side wall adjacent the partition wall portion and with all of the second surface of the partition wall portion to embed parts of the intermediate terminals except the electrical contact portions therein.

3. A water stop structure for a wire harness for connecting an electronic control unit installed in an automotive vehicle or a motorcycle and devices, characterized in that:

the wire harness is divided into a first wire harness section with a first housing and a plurality of first terminals locked in the first housing, the first terminals being crimped respectively into connection with first wires and a second wire harness section with a second housing and a plurality of second terminals locked in the second housing, the second terminals being crimped respectively into connection with second wires, the first terminals including electrical contact portions connectable respectively with electrical contact portions of the second terminals, the first connector having a terminal mounting wall and a tubular wall projecting forward from the terminal mounting wall to define a receptacle, the electrical contact portions of the first terminals projecting into the receptacle, the second housing being insertable into the receptacle of the first housing so that the electrical contact portions of the second terminals connect with the electrical contact portions of the first housing, and a waterproofing agent is filled in part of the receptacle of the first housing and cured in place in contact with a circumferentially continuous part of the tubular wall adjacent the terminal mounting wall and with all of the terminal mounting wall facing into the receptacle to embed parts of the first terminals including wire crimping portions, but excluding the electrical contact portions therein.

4. A water stop structure according to claim 2, wherein:

the both ends of each intermediate terminal to be mounted in the intermediate connector are narrow and long flat plates including the electrical contact portions which are male terminal portions and female terminals are connected to wire ends of the divided wire harnesses and inserted and locked in the first and second connectors, or each intermediate terminal includes a male terminal portion at one end and a female terminal portion at the other end, female terminal portions to be connected to the male terminal portions and male terminal portions to be connected to the female terminal portions are provided at the wire ends to be inserted and locked in the first and second connectors.

5. A water stop structure according to claim 2, wherein the waterproofing agent is a gel-like sealant or a liquid potting sealant and is filled and cured in a terminal mounting area in the intermediate connector.

6. A water stop structure according to claim 2, wherein:

the electronic control unit is one or more selected from an engine control unit, a fuel injection control unit, an ABS control unit, an airbag control unit, a running safety control unit, a vehicle radar control unit and a night-vision camera control unit, and devices connected to the electronic control unit are:

one or more controllable devices selected from a light, a washer, a door lock, an anti-theft horn and a starter which are controlled by the electronic control unit, information transmitters including sensors such as an $O_2$ sensor, a speed sensor and a knock sensor, which are adapted to transmit information to the electronic control unit, and/or another electronic control unit, and one or more electrical components selected from a fuse, a relay, a connector and a ground member of an electrical connection box.

7. A water stop structure according to claim 2, wherein:

each intermediate terminal to be mounted in the intermediate connector has one end thereof projecting into the first connector fitting portion formed into a female terminal portion and the other end thereof projecting into the second connector fitting portion formed into a male terminal portion, and the connector in the electronic control unit is a board mounting connector, male terminal portions of the board mounting connector are connected to the female terminal portions and female terminal portions of the wire harness side connector are connected to the male terminal portions.

8. A water stop structure according to claim 7 wherein:

the intermediate connector is constructed such that upper and lower walls of the second connector fitting portion project at positions more outward than upper and lower walls of the first connector fitting portion to make a cross sectional area of the second connector fitting portion larger than that of the first connector fitting portion, the partition wall is provided in the second connector fitting portion and the waterproofing agent is filled in the second connector fitting portion in contact with the partition wall, the first connector fitting portion projects into the housing of the electronic control unit, and the second connector fitting portion projects out from the housing.

9. A water stop structure according to claim 8, wherein the waterproofing agent is a gel-like sealant or a liquid potting sealant and is filled and cured in a terminal mounting area in the housing of the first or second connector or in the intermediate connector.

10. A water stop structure according to claim 9, wherein:

the electronic control unit is one or more selected from an engine control unit, a fuel injection control unit, an ABS control unit, an airbag control unit, a running safety control unit, a vehicle radar control unit and a night-vision camera control unit, and devices connected to the electronic control unit are:

one or more controllable devices selected from a light, a washer, a door lock, an anti-theft horn and a starter which are controlled by the electronic control unit, information transmitters including sensors such as an $O_2$ sensor, a speed sensor and a knock sensor, which are adapted to transmit information to the electronic control unit, and/or another electronic control unit, and one or more electrical components selected from a fuse, a relay, a connector and a ground member of an electrical connection box.

* * * * *